US005347725A

United States Patent [19]

Sato

[11] Patent Number: 5,347,725

[45] Date of Patent: Sep. 20, 1994

[54] METHOD AND APPARATUS FOR VACUUM DRYING COLLOIDAL SUBSTANCES

[75] Inventor: Takuya Sato, Suita, Japan

[73] Assignee: Sato Iron Works Co., Ltd., Osaka, Japan

[21] Appl. No.: 67,439

[22] Filed: May 24, 1993

[30] Foreign Application Priority Data

Jun. 9, 1992 [JP] Japan ..... 4-147858

[51] Int. Cl.[5] ..... F26B 7/00

[52] U.S. Cl. ..... 34/386; 34/61; 34/73; 34/92; 34/409; 159/4.01

[58] Field of Search ..... 34/5, 15, 16, 92, 12, 34/13, 17, 35, 57, R, 73, 74, 86, 60, 61, 62; 159/4.01

[56] References Cited

U.S. PATENT DOCUMENTS 3,210,861 10/1965 Eolkin ..... 34/5
3,300,868 1/1967 Anderwert ..... 34/5
3,310,881 3/1967 Fritzberg ..... 34/15
3,313,032 4/1967 Malecki ..... 34/5
3,362,835 1/1968 Thuse et al. ..... 34/5
3,396,475 8/1968 Scheibel ..... 34/5
5,208,998 5/1993 Oyler, Jr. ..... 34/5

*Primary Examiner*—Denise Gromada
*Attorney, Agent, or Firm*—Felfe & Lynch

[57] ABSTRACT

A colloidal substance is injected into a vacuum chamber to be dehydrated therein. The dehydrated substance is extracted from the vacuum chamber by a screw extruder disposed at a bottom of the vacuum chamber. A gas resulting from the dehydration is drawn from the vacuum chamber into a surface condenser to be cooled through an indirect heat exchange with cooling water. After the dehydration of the substance, the extraction of the dehydrated substance and the cooling of the gas are carried out in parallel.

12 Claims, 4 Drawing Sheets

METHOD AND APPARATUS FOR VACUUM DRYING COLLOIDAL SUBSTANCES

BACKGROUND OF THE INVENTION

1. Field of the Invention

This invention relates to an improvement in a method and apparatus for vacuum alehydrating a colloidal substance such as neat soap, glycerin, or varied fats and oils, and cooling and releasing a gas resulting from the vacuum dehydration.

2. Description of the Related Art

FIGS. 4 and 5 show a conventional method and apparatus of this type for treating a colloidal substance.

In the vacuum drying apparatus, as shown in FIG. 4, a colloidal substance to be treated is taken from a raw material supplying device 1, and supplied to a vacuum drying tower 2 after being heated through a heat exchange with heating vapor. The substance is injected into a vacuum chamber 9 to be dehydrated under saturated vapor pressure. The dehydrated substance is transferred from a bottom of the vacuum chamber 9 to a substance extractor 3 for kneading and discharging the substance. A gas discharged from the vacuum drying tower 2 is cooled in a cooling device 4 by cooling water supplied from a cooling tower 4A. As shown in FIG. 5, the cooling device 4 comprises a raindrop type barometric condenser for forming water screens across a gas passage therein. The discharged gas is forced to contact the cold water to be cooled.

The prior art noted above has the following drawbacks.

In view of the relationship of saturated vacuum to temperature, the water acting as a refrigerant in the cooling process should be as cold as possible to secure a high degree of vacuum. Thus, the water used is recirculated while being cooled. However, the recirculating water carries fine particles of soup captured through contact, and becomes turbid and foamy. In addition, a large quantity of soap particles adhere to the cooling tower to lower its cooling effect. Consequently, part of the recirculating water must constantly be withdrawn from the recirculating system, with replenish water constantly introduced into the recirculating system to compensate for the withdrawn part of water. This is uneconomical in that a large quantity of water is used.

The cooling tower has the advantage of allowing impurities to mix into the water to some extent. However, a temperature difference between inlet and outlet of the cooling tower can be set to only about 5° C. to maintain its function. In summer when the water temperature may rise to about 30° C., the function to cool the discharged gas could deteriorate to lower the degree of vacuum, thereby adversely influencing the drying treatment.

Moreover, the barometric condenser must be installed at a height at least 11 meters over a liquid surface of a water seal tank in order to maintain the degree of vacuum. Consequently, the entire apparatus tends to be large, and involves difficulties of maintenance operations to be carried out at high locations.

A vacuum pump used as a suction device must draw air contained in the water used in the barometric condenser as well as the gas resulting from the dehydration in the vacuum drying tower. This requires the vacuum pump to have a large displacement.

SUMMARY OF THE INVENTION

The object of the present invention is to provide efficient and economical cooling of the gas resulting from a vacuum drying treatment, and avoid enlargement of the entire apparatus and difficulties in maintenance thereof.

The above object is fulfilled, according to one aspect of the present invention, by a method of vacuum drying a colloidal substance comprising the steps of dehydrating the colloidal substance in a vacuum chamber by injecting the colloidal substance thereinto, kneading and extracting a substance dehydrated in the vacuum chamber, and cooling a gas withdrawn from the vacuum chamber through an indirect heat exchange with a refrigerant, wherein the extracting step and the cooling step are carded out in parallel after the alehydrating step.

In a further aspect of the invention, an apparatus for vacuum drying a colloidal substance is provided which comprises a raw material supplying device for supplying the colloidal substance, a vacuum drying tower for vacuum dehydrating the colloidal substance, a suction device for exhausting a gas from the vacuum drying tower to maintain a vacuum in the vacuum drying tower, a substance extracting device for receiving a treated substance from the vacuum drying tower and kneading and outputting the substance, and a cooling device mounted in an intermediate position of an exhaust line extending from the vacuum drying tower to the suction device to cool the gas exhausted from the vacuum drying tower, wherein the cooling device is a surface condenser for effecting an indirect heat exchange.

The above technical aspects of the invention provide the following functions.

The surface condenser for effecting an indirect heat exchange has a refrigerant passage and an exhaust gas passage in spiral form and partitioned by a heat exchange plate. Thus, the refrigerant and exhaust gas do not come into direct contact with each other. The refrigerant may be recirculated without being contaminated by the exhaust gas. Consequently, the refrigerant is not limited to water cooled by a cooling tower, but may be water cooled by a chiller or may be a different cooling liquid. Such a refrigerant may be maintained at a constant temperature through all seasons.

The exhaust gas passage and the cooling water passage are completely separated, and there is no possibility of external gases entering the exhaust gas passage. Thus, since the exhaust gas need not be maintained in a reduced pressure condition by means of a water seal structure, the invention does not involve the restriction that the cooling device must be placed at a high location for water seal.

The method and apparatus according to the present invention have the following advantages over the conventional method and apparatus for vacuum drying a colloidal substance:

(a) The method and apparatus according to the present invention do not require an uneconomical practice of constantly discharging part of the cooling water acting as the refrigerant out of the recirculating system as is done where the exhaust gas and refrigerant directly contact each other for heat exchange. In addition, chiller-cooled water constantly having a sufficiently low temperature may be used to produce a steady cooling effect at all times. This facilitates maintenance of a high drying efficiency.

(b) There is no inconvenience of having to install the cooling device at a height at least 11 meters over a liquid surface of a water seal tank in order to maintain a vacuum as where a barometric condenser is employed. The cooling device may be disposed in a low position to avoid enlargement of the entire apparatus and facilitate maintenance.

(c) The suction device will serve the purpose as long as its capacity is sufficient to maintain a predetermined degree of vacuum for the exhaust gas resulting from the dehydrating treatment in the vacuum drying tower. Thus, the suction device may be a small vacuum pump having a relatively small displacement since it is unnecessary to exhaust air contained in water used as heat medium as where a barometric condenser is used.

The foregoing and other objects, features and advantages of the invention will be apparent from the following more particular description of the preferred embodiment of the invention, as illustrated in the accompanying drawings.

DETAILED DESCRIPTION OF THE PREFERRED EMBODIMENT

A method and apparatus for vacuum drying a colloidal substance according to the present invention will be described in detail with reference to the drawings.

The vacuum drying method according to the present invention will be described first.

The colloidal substance to be treated may be neat soap, glycerin, or varied fats and oils. These are collectively called herein a treated substance A.

Figure 1:
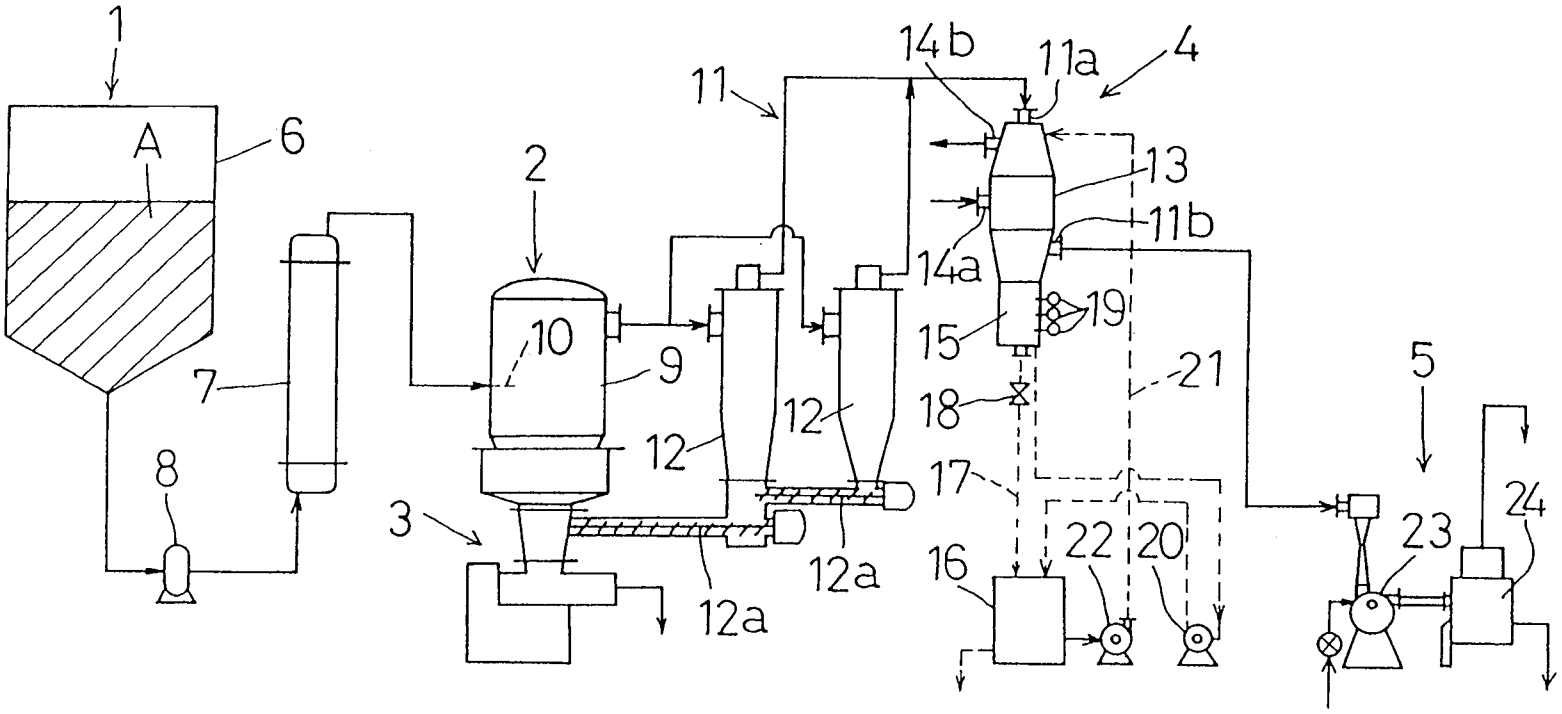
FIG. 1 is an explanatory view of an entire apparatus for vacuum drying a colloidal substance.

Referring to FIG. 1, the method in this embodiment includes a dehydrating step for dehydrating neat soap which is the treated substance supplied from a raw material supplying device 1, an extracting step for extracting the dehydrated substance, and a cooling step for cooling a gas in the course of its withdrawal by suction. These steps are carried out in the following sequence:

[1] A vacuum drying tower 2 is disposed downstream of the raw material supplying device 1 with respect to a treated substance feeding direction. The vacuum drying tower 2 includes a vacuum chamber 9 into which the treated substance is injected to receive the dehydrating step under a vacuum condition. For the dehydrating step, the neat soap stored in a raw material tank 6 of the raw material supplying device 1 and having a water content of 30 to 33% is subjected to a heat exchange with heating vapor in a heat exchanger 7 disposed upstream of the vacuum drying tower 2. As a result, the neat soap is heated to about 130° C. prior to injection into the vacuum chamber 9 through a nozzle. The vacuum chamber 9 has an internal gas pressure maintained at about 50 torr under control of a suction device 5. The neat soap, after the dehydration, has a water content of about 12 to 15%.

[2] A substance extracting device 3 is disposed at the bottom of the vacuum chamber 9, which is in the form of an extruder including a helical screw and a forming die. The extracting device 3 forms and outputs the dehydrated substance with kneading and extruding action of the helical screw. The extruding action of the extracting device 3 provides the extracting step.

[3] A gas evaporating from the dehydrated substance in the vacuum chamber 9 of the vacuum drying tower 2 is at a temperature in the order of 50° C.. The evaporating gas flows, under drawing action of the suction device 5, through exhaust lines 11 and cyclone dust collectors 12 to a cooling device 4. The gas is subjected to an indirect heat exchange in the cooling device 4 with cooling water at a temperature of about 10° C. acting as a refrigerant, and is drawn to the suction device 5. The cooling water used in this cooling step is supplied from a chiller.

[4] The cooled gas drawn by the suction device 5 is subjected to a gas/liquid contact to be stripped of matters contained therein, and then released to the ambient.

[5] The extracting step in paragraph [2] and the cooling step in paragraph [3] are carried out in parallel after the alehydrating step.

The vacuum drying apparatus according to the present invention will be described next.

FIG. 1 shows the apparatus for vacuum drying a colloidal substance in this embodiment. The apparatus includes the raw material supplying device 1 for supplying the substance to be treated, the vacuum drying tower 2 for vacuum alehydrating the substance supplied from the raw material supplying device 1, the suction device 5 for drawing the gas from the vacuum drying tower 2 to maintain a vacuum in the vacuum drying tower 2, the substance extracting device 3 for kneading and discharging the material received from the vacuum drying tower 2, and the cooling device 4 for cooling the exhaust gas in an intermediate position of the exhaust line 11 extending from the vacuum drying tower 2 to the suction device 5.

The raw material supplying device 1 includes the raw material tank 6 for storing the neat soap which is the substance to be treated, the heat exchanger 7 for heating the neat soap through an indirect heat exchange with the heating vapor, and a transporting pump 8 for delivering the neat soap in the raw material tank 6 to the heat exchanger 7 and vacuum drying tower 2. The heat exchanger 7 receives high temperature vapor at about 160° to 170° C. from an external boiler (not shown). The neat soap is heated to about 130° C. prior to injection into the vacuum drying tower 2.

The vacuum drying tower 2 includes an injection nozzle 10 disposed in a vertically intermediate position of the vacuum chamber 9 for injecting the neat soap thereinto. The vacuum chamber 9 has an opening in the bottom thereof for communicating with the substance extracting device 3. Two cyclone dust collectors 12 are connected in upper positions thereof to the exhaust lines 11 extending from the vacuum drying tower 2, and in lower positions to screw feeders **12*a* communicating with the bottom of the vacuum chamber 9 of the vacuum drying tower 2**.

With this construction, the gas dawn from the vacuum chamber 9 into the exhaust lines 11 is fed to the cyclone dust collectors 12 to be stripped of dust, and then fed to the cooling device 4. Fine particles of dust captured are returned by the screw feeders 12*a* to the bottom of the vacuum chamber 9. The dehydrated substance is discharged through the bottom opening of the vacuum chamber 9 to the substance extracting device 3.

The substance extracting device 3 includes the helical screw communicating with the vacuum chamber 9 through the bottom opening thereof, and the forming die disposed at an outlet end of the helical screw. The dehydrated substance is formed and outputted under the extruding action of the helical screw. Thus, the substance extracting device 3 is constructed in the same way as a well-known extrusion molding machine, in which the substance under treatment is kneaded and extruded through the forming die.

Figure 2:
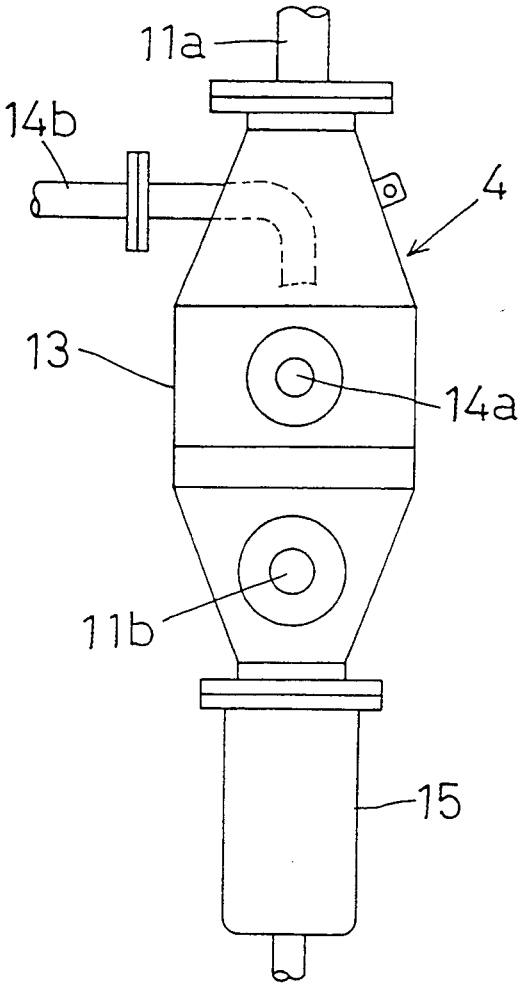
FIG. 2 is a side view of a surface condenser.
Figure 3:
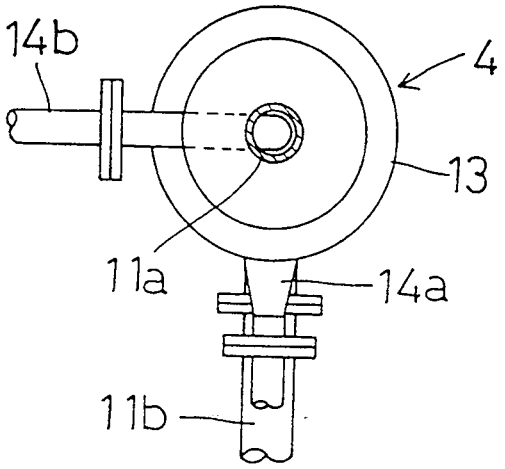
FIG. 3 is a plan view of the surface condenser.
Figure 4:
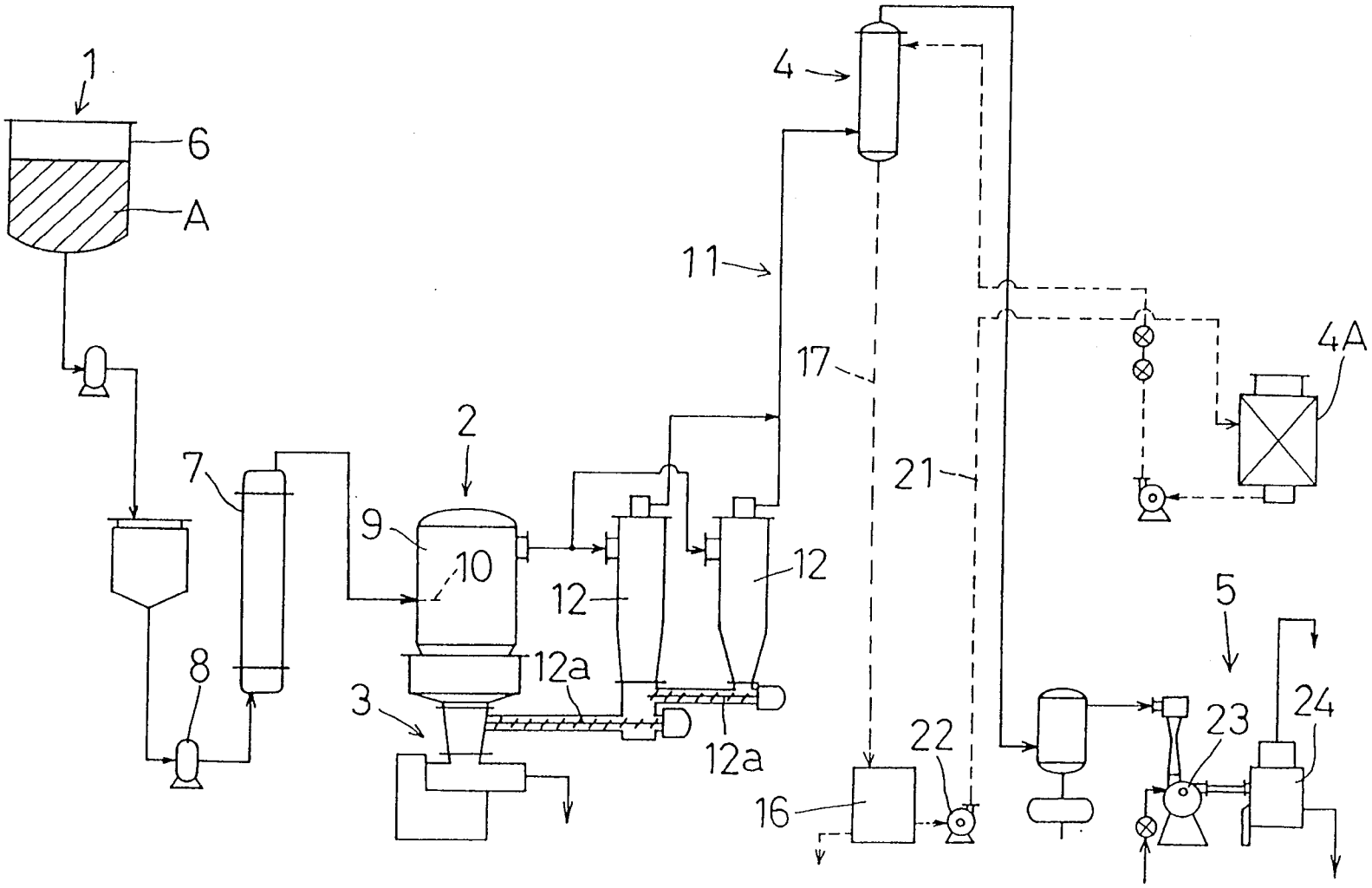
FIG. 4 (PRIOR ART)
FIG. 4 is an explanatory view of an entire apparatus for vacuum drying a colloidal substance according to the prior art.
Figure 5:
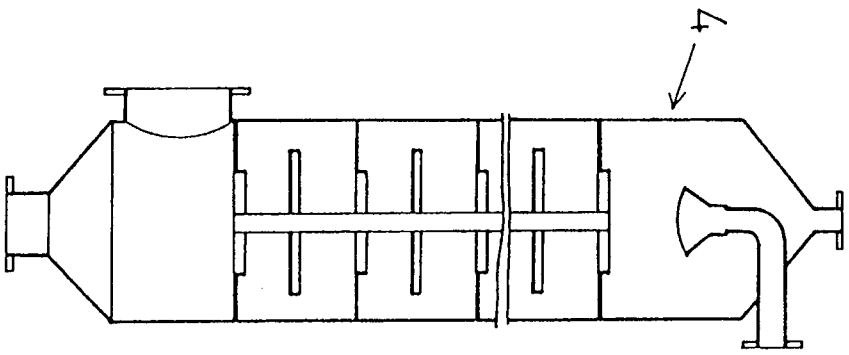
FIG.5 (PRIOR ART)
FIG. 5 is a sectional view of a barometric condenser according to the prior art.

As shown in FIGS. 1 through 3, the cooling device 4 is in the form of a surface condenser for effecting an indirect heat exchange. That is, fluids having different temperatures are in two chambers partitioned by a wall, and a heat exchange is effected through surfaces of this wall.

The cooling device 4 includes an outer case 13 defining therein two spiral passages adjacent each other. One of the passages is connected to an exhaust inlet 11*a* of the exhaust line 11 and to an exhaust outlet 11*b* of the exhaust line 11. The other passage is connected to a water inlet 14*a* of a cooling water line for transmitting cooling water from an external chiller, and to a water outlet 14*b* of a cooling water line for transmitting the water to the chiller. The cooling device 4 further includes a drain tank 15 disposed in a lower position and not communicating with the exhaust lines 11 or cooling water lines, for collecting dew condensation adhering to the partition wall used in the indirect heat exchange. A drain pipe 17 extends from a bottom opening of the drain tank 15 to a storage tank 16 disposed below. The drain pipe 17 has a switch valve 18 mounted in an intermediate position thereof. The drain tank 15 has a level sensor 19 for detecting a water level therein. When the water level exceeds a predetermined level, a drain pump 20 is automatically operated to drain the water from the drain tank 15.

The storage tank 16 is connected to an upper position of the cooling device 4 through a communicating line 21. The interior of the cooling device 4 may be cleaned, as necessary, by operating a cleaning pump 22 disposed in an intermediate position of the communicating line 21. The switch valve 18 is opened at this time.

The suction device 5 includes a vacuum pump 23 connected to the exhaust line 11 extending from the cooling device 4, and an after-treatment device 24 connected to an exhaust line 11 extending from the vacuum pump 23. The vacuum pump 23 draws the exhaust gas from the cooling device 4, and feeds the gas to the after-treatment device 24 where the gas is subjected to a gas/liquid contact to be stripped of matters contained therein before release to the ambient.

The foregoing embodiment may be modified as follows:

(1) The substance to be treated is not limited to neat soap, but may be various other colloidal substances such as glycerin and fats and oils.

(2) The heating device of the raw material supplying device 1 is not limited to the heat exchanger 7 which effects a heat exchange with vapor. Various other types of heating device may be employed.

(3) The dust collectors 12 are not limited to the cyclone type but may be other types. These devices could be omitted.

(4) The refrigerant is not limited to the water from the chiller, but may be a mixture of water and a different substance or substances or may be a substance other than water.

What is claimed is:

1. A method of vacuum drying a colloidal substance comprising the steps of:

dehydrating said colloidal substance by subjecting the substance stored in a raw material tank of a raw material supplying device to a heat exchange with heating vapor in a heat exchanger disposed upstream a vacuum drying tower, and then injecting the substance into a vacuum chamber;

kneading and extracting a substance dehydrated in said vacuum chamber;

cooling a gas withdrawn from said vacuum chamber through an indirect heat exchange with a refrigerant by utilizing a surface condenser;

discharging a gas sucked and exhausted from said vacuum chamber into the atmosphere; and carrying out said extracting step and said cooling step in parallel after said dehydrating step.

2. A vacuum drying method as defined in claim 1, wherein the dehydrating step is carried out such that said vacuum chamber has an internal gas pressure maintained at a lower level under control of a suction device.

3. A vacuum drying method as defined in claim 1, wherein the kneading and extracting step is carried out by operating a substance extracting device disposed at a bottom of said vacuum chamber to form and output the dehydrated substance with kneading and extruding action of a helical screw of said extracting device.

4. A vacuum drying method as defined in claim 1, wherein the cooling step is carried out by subjecting the gas withdrawn from said vacuum chamber to an indirect heat exchange in a cooling device with cooling water supplied as the refrigerant from a chiller.

5. An apparatus for vacuum drying a colloidal substance comprising:

raw material supplying means for supplying said colloidal substance;

a vacuum drying tower for vacuum dehydrating said colloidal substance;

suction means for exhausting a gas from said vacuum drying tower to maintain a vacuum in said vacuum drying tower;

substance extracting means for receiving a treated substance from said vacuum drying tower, and kneading and outputting the substance; and cooling means mounted in an intermediate position of an exhaust line extending from said vacuum drying tower to said suction means to cool the gas exhausted from said vacuum drying tower;

wherein said cooling means is a surface condenser for effecting an indirect heating exchanger; and wherein said raw material supplying means comprises a heat exchanger for heating said substance through an indirect heat exchange with heating vapor.

6. A vacuum drying apparatus as defined in claim 5, wherein said raw material supplying means includes:

a raw material tank for storing the colloidal substance to be treated; and a transporting pump for delivering said substance in said raw material tank to said heat exchanger and said vacuum drying tower.

7. A vacuum drying apparatus as defined in claim 5, wherein said vacuum drying tower includes:

a vacuum chamber connected in an upper position thereof to said exhaust line and having an opening in a bottom thereof for communicating to said substance extracting means; and a substance injecting nozzle disposed in a vertically intermediate position of said vacuum chamber.

8. A vacuum drying apparatus as defined in claim 7, wherein said substance extracting means includes:

a helical screw communicating with said opening in the bottom of said vacuum chamber; and a forming die disposed at an outlet end of said helical screw.

9. A vacuum drying apparatus as defined in claim 5, wherein said cooling means includes an outer case defining therein two spiral passages adjacent each other, one of said passages being connected to an exhaust inlet of said exhaust line and to an exhaust outlet of a further exhaust line, the other passage being connected to a water inlet of a cooling water line for transmitting cooling water from an external chiller, and to a water outlet of a cooling water line for transmitting the water to the chiller.

10. A vacuum drying apparatus as defined in claim 9, wherein said cooling means further includes a drain tank disposed in a lower position thereof and out of communication with said exhaust lines and said cooling water lines, for collecting dew condensation adhering to a partition wall used in said indirect heat exchange.

11. A vacuum drying apparatus as defined in claim 5, wherein said colloidal substance is neat soap.

12. A vacuum drying apparatus as defined in claim 5, wherein said suction means includes a vacuum pump connected to an exhaust line extending from said cooling means, and after-treatment means connected to an exhaust line extending from said vacuum pump.

* * * * *